US012330823B2

(12) United States Patent
Richter et al.

(10) Patent No.: US 12,330,823 B2
(45) Date of Patent: Jun. 17, 2025

(54) STRAPPING MACHINE WITH A WELDING ASSEMBLY HAVING A LEADING-STRAP-END GUIDE AND METHOD OF OPERATING SAME

(71) Applicant: Signode Industrial Group LLC, Tampa, FL (US)

(72) Inventors: Philipp Richter, Eckersdorf (DE); Stefan Ries, Bindlach (DE); Jens Bittermann, Bayreuth (DE)

(73) Assignee: SIGNODE INDUSTRIAL GROUP LLC, Tampa, FL (US)

( * ) Notice: Subject to any disclaimer, the term of this patent is extended or adjusted under 35 U.S.C. 154(b) by 98 days.

(21) Appl. No.: 18/493,375

(22) Filed: Oct. 24, 2023

(65) Prior Publication Data

US 2024/0150052 A1 May 9, 2024

Related U.S. Application Data

(60) Provisional application No. 63/382,610, filed on Nov. 7, 2022.

(51) Int. Cl.
*B65B 13/32* (2006.01)

(52) U.S. Cl.
CPC ..... *B65B 13/32* (2013.01)

(58) Field of Classification Search
CPC ..... B65B 13/04; B65B 13/187; B65B 13/32
(Continued)

(56) References Cited

U.S. PATENT DOCUMENTS 3,470,814 A * 10/1969 Tschappu ..... B65B 13/32 53/589
4,016,023 A * 4/1977 Takami ..... B65B 13/32 156/499

(Continued)

FOREIGN PATENT DOCUMENTS

CH 704089 A2 5/2012
CN 113650838 A 11/2021

(Continued)

OTHER PUBLICATIONS

EAM Mosca Strapping Systems' "UATRI-2XT Strapping Machine" Brochure, available at: https://www.eammosca.com/product/uatri-2xt/, 2 pages, Nov. 2, 2022.

(Continued)

*Primary Examiner* — Stephen F. Gerrity
(74) *Attorney, Agent, or Firm* — Neal, Gerber & Eisenberg LLP

(57) ABSTRACT

Various embodiments of the present disclosure provide a strapping machine with a welding assembly including a counter-pressure plate and a heating element that cooperate to attach two overlapping portions of strap to each other to form a loop of strap around a load. The welding assembly includes various clamps and a leading-strap-end guide that clamp the strap at various points in time during a strapping cycle to prevent the strap from misaligning. After the loop of strap has been formed around the load and the load has been removed from the strapping machine, the welding assembly manipulates the leading end of the strap extending from the strap supply and clamps it via the clamps and the leading-strap-end guide to align the strap for the next strapping cycle.

12 Claims, 18 Drawing Sheets

(58) Field of Classification Search
USPC ..... 53/399, 586; 100/2, 33 PB
See application file for complete search history.

(56) References Cited

U.S. PATENT DOCUMENTS

| | | | | |
|---|---|---|---|---|
| 4,435,945 | A | 3/1984 | Roehrig | |
| 4,512,844 | A | 4/1985 | Kobiella | |
| 4,850,179 | A | 7/1989 | Takami | |
| 5,170,612 | A * | 12/1992 | Sumino | B65B 13/08 53/589 |
| 5,513,482 | A * | 5/1996 | Nagashima et al. | B65B 13/32 53/589 |
| 10,865,004 | B2 | 12/2020 | Tanner | |
| 2018/0022489 | A1 | 1/2018 | Tanner | |
| 2021/0094714 | A1 | 4/2021 | Hoffman et al. | |
| 2021/0394940 | A1 | 12/2021 | Lai | |

FOREIGN PATENT DOCUMENTS

| | | | | |
|---|---|---|---|---|
| DE | 2437229 | A1 * | 2/1976 | B65B 13/32 |
| DE | 3929710 | C2 | 6/1993 | |
| DE | 9418542 | U1 | 1/1995 | |
| EP | 0178385 | A1 | 4/1986 | |
| EP | 0401554 | A1 | 12/1990 | |
| EP | 0403190 | A2 | 12/1990 | |
| EP | 2149448 | A2 * | 2/2010 | B65B 13/32 |
| EP | 3798143 | A1 | 3/2021 | |
| WO | 9215486 | A1 | 9/1992 | |

OTHER PUBLICATIONS

"Mosca UATRI machine", pictures from video of machine in operation, 71 pages, available before the priority date of this patent application.

"Spareparts Catalogue MOSCA UATRI", 364 pages, available before the priority date of this patent application.

"Extended European Search Report", from corresponding European Patent Application No. 23207875.8, Mar. 19, 2024.

* cited by examiner

STRAPPING MACHINE WITH A WELDING ASSEMBLY HAVING A LEADING-STRAP-END GUIDE AND METHOD OF OPERATING SAME

PRIORITY

This application claims priority to and the benefit of U.S. Provisional Patent Application No. 63/382,610, filed Nov. 7, 2022, the entire contents of which is incorporated herein by reference.

FIELD

The present disclosure relates to a strapping machine for strapping loads, and more particularly to a strapping machine with a welding assembly including a counter-pressure plate and a heating element that cooperate to attach two overlapping portions of strap to each other to form a loop of strap around a load.

BACKGROUND

A strapping machine forms a loop of plastic strap (such as polyester or polypropylene strap), metal strap (such as steel strap), or paper strap around a load. A typical strapping machine includes a support surface that supports the load, a strapping head that forms the strap loop using strap drawn from a strap supply, a controller that controls the strapping head to strap the load, and a frame that supports these components. A typical strapping head includes a sealing assembly for attaching two overlapping portions of the strap together to form the strap loop and for cutting the strap from the strap supply. There are many different types of strap-sealing assemblies that attach the overlapping portions of the strap to one another in different ways. Certain strapping machines configured for plastic and paper strap include a sealing assembly with a friction welder, a heating element (such as a resistive heater for heating a workpiece), or an ultrasonic welder configured to attach the leading and trailing strap ends to one another. Some strapping machines configured for plastic strap or metal strap include a sealing assembly with jaws that mechanically deform (referred to as "crimping" in the industry) or cut notches into (referred to as "notching" in the industry) a seal element positioned around the leading and trailing strap ends to attach them to one another. Other strapping machines configured for metal strap include a sealing assembly with punches and dies configured to form a set of mechanically interlocking cuts in the leading and trailing strap ends to attach them to one another (referred to in the strapping industry as a "sealless" attachment). Still other strapping machines configured for metal strap include a sealing assembly with spot, inert-gas, or other welders configured to weld the leading and trailing strap ends to one another.

SUMMARY

Various embodiments of the present disclosure provide a strapping machine with a welding assembly including a counter-pressure plate and a heating element that cooperate to attach two overlapping portions of strap to each other to form a loop of strap around a load. The welding assembly includes various clamps and a leading-strap-end guide that clamp the strap at various points in time during a strapping cycle to prevent the strap from misaligning. After the loop of strap has been formed around the load and the load has been removed from the strapping machine, the welding assembly manipulates the leading end of the strap extending from the strap supply and clamps it via the clamps and the leading-strap-end guide to align the strap for the next strapping cycle.

DETAILED DESCRIPTION

Figure 1A:
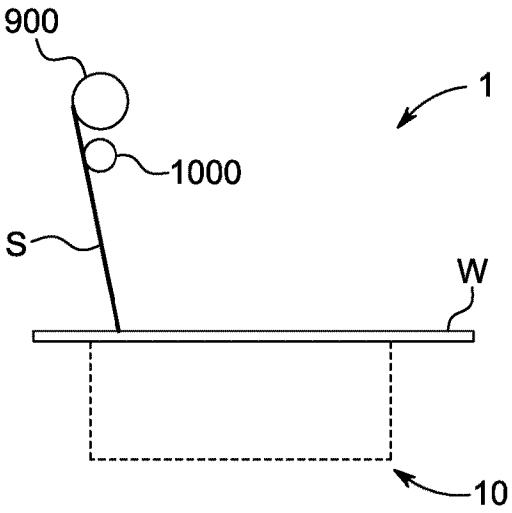
FIGS. 1A-1E are diagrammatic side views of one example embodiment of a strapping machine of the present disclosure strapping a load.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

FIGS. 1A-3O show one example embodiment of a strapping machine 1 of the present disclosure and certain assemblies and components thereof. The strapping machine 1 includes a strapping-machine frame (not shown for clarity), a work platform W supported by the strapping-machine frame, a sealing assembly 10 below the work platform W, a strap supply 900 supported by the strapping-machine frame above the work platform W, a first strap manipulator 1000 supported by and movable relative to the strapping-machine frame, and a controller (not shown).

Figure 1B:
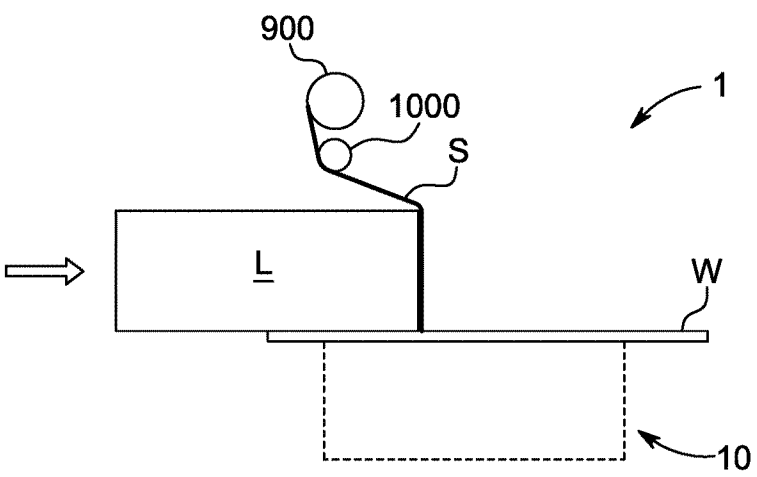
Figure 1C:
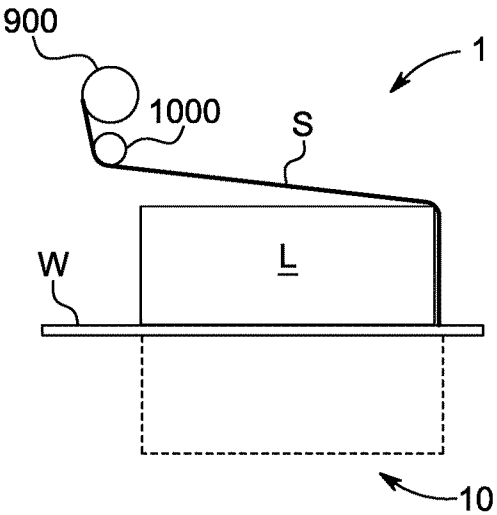
Figure 1D:
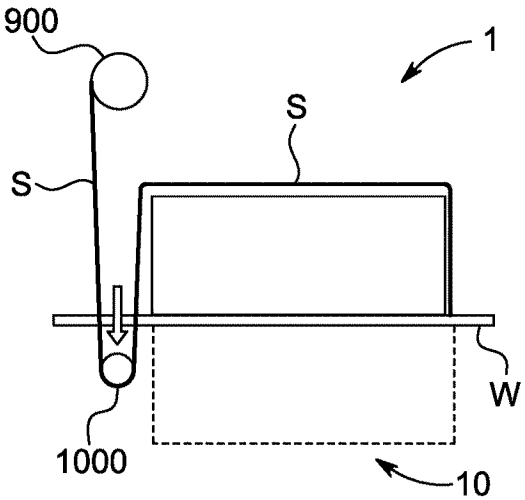
Figure 1E:
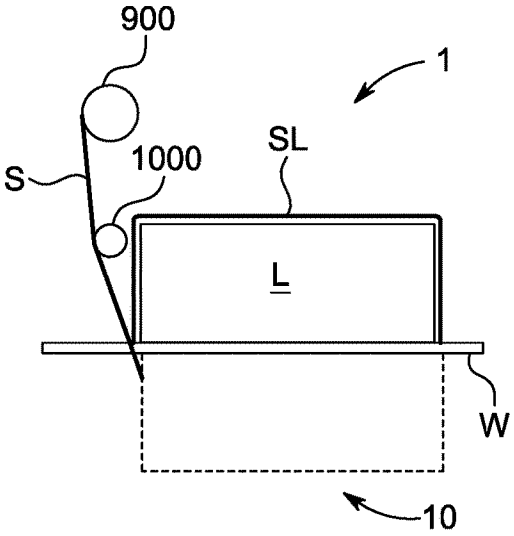

FIGS. 1A-1E show the strapping machine 1 carrying out a strapping cycle to form a strap loop SL of strap S around a load L, such as a stack of flattened corrugated boxes. Initially, as shown in FIG. 1A, the sealing assembly 10 clamps the leading end (not shown) of the strap S below the work platform W, the strap S extends from the sealing assembly 10 to the strap supply 900, and the first strap manipulator 1000 is in a home position near the strap supply 900. As shown in FIG. 1B, the load L is positioned atop the work platform W and moved by a conveyor (or a pusher or other suitable device) toward the strap S. The leading end of the load L contacts the strap S, and as the conveyor continues to move the load L, the movement of the load L relative to the strap supply 900 combined with the sealing assembly 10 clamping the leading strap end results in strap S being pulled from the strap supply 900 and extending across the top surface of the load L. The conveyor stops moving the load L once the load L reaches a welding position over the sealing assembly 10, as shown in FIG. 1C. The first strap manipulator 1000 descends from its home position to a sealing position below the work platform W and adjacent the sealing assembly 10, as shown in FIG. 1D. This movement extends the strap S behind the trailing end of the load L. After the first strap manipulator 1000 reaches the sealing position, the sealing assembly 10 manipulates the strap S, cuts the strap S from the strap supply 900 to form a trailing strap end, and welds portions of the strap adjacent the leading and trailing strap ends together to form the strap loop SL around the load L, as described below. This process also results in the sealing assembly 10 forming and clamping a new leading strap end (not shown) and positioning the strap in preparation for the next strapping cycle, as described below. As shown in FIG. 1E, the first strap manipulator 1000 begins ascending back to its home position in preparation for the next strapping cycle. While the strap loop SL is formed tight on the load L, in certain of FIGS. 1A-1E the strap loop SL is shown spaced apart from the load L for clarity.

FIGS. 2A-3O show the sealing assembly 10, which manipulates strap to form a strap loop around a load, and components thereof. The sealing assembly 10 includes a sealing-assembly frame 100, a welding assembly 300, and a drive assembly 600.

The sealing-assembly frame 100 supports some (or all) of the other components of the sealing assembly 10 and may be formed of any suitable components arranged in any suitable configuration. In this example embodiment, the sealing-assembly frame 100 is attached to the underside of the work platform W in any suitable manner, though in other embodiments the sealing-assembly frame 100 may be attached to the strapping-machine frame instead of or in addition to the work platform W.

The welding assembly 300, which is best shown in FIGS. 2B-3O, manipulates, cuts, and welds the strap to form the strap loop around the load. The welding assembly 300 includes a movable counter-pressure plate 310 having a generally planar body 312 and a downwardly extending lip 314; a movable workpiece 320; a heating element (not shown), such as a resistive heater, configured to heat the workpiece 320; a movable first strap clamp 330 having a clamping surface 330*s*; a movable second strap clamp 340 having upper and lower clamping surfaces 340*u* and 3401; a movable third strap clamp 350 having a clamping surface 350*s*; a movable fourth strap clamp 360 having a clamping surface 360*s*; a leading-strap-end guide 400; and a second strap manipulator 500.

Figure 2A:
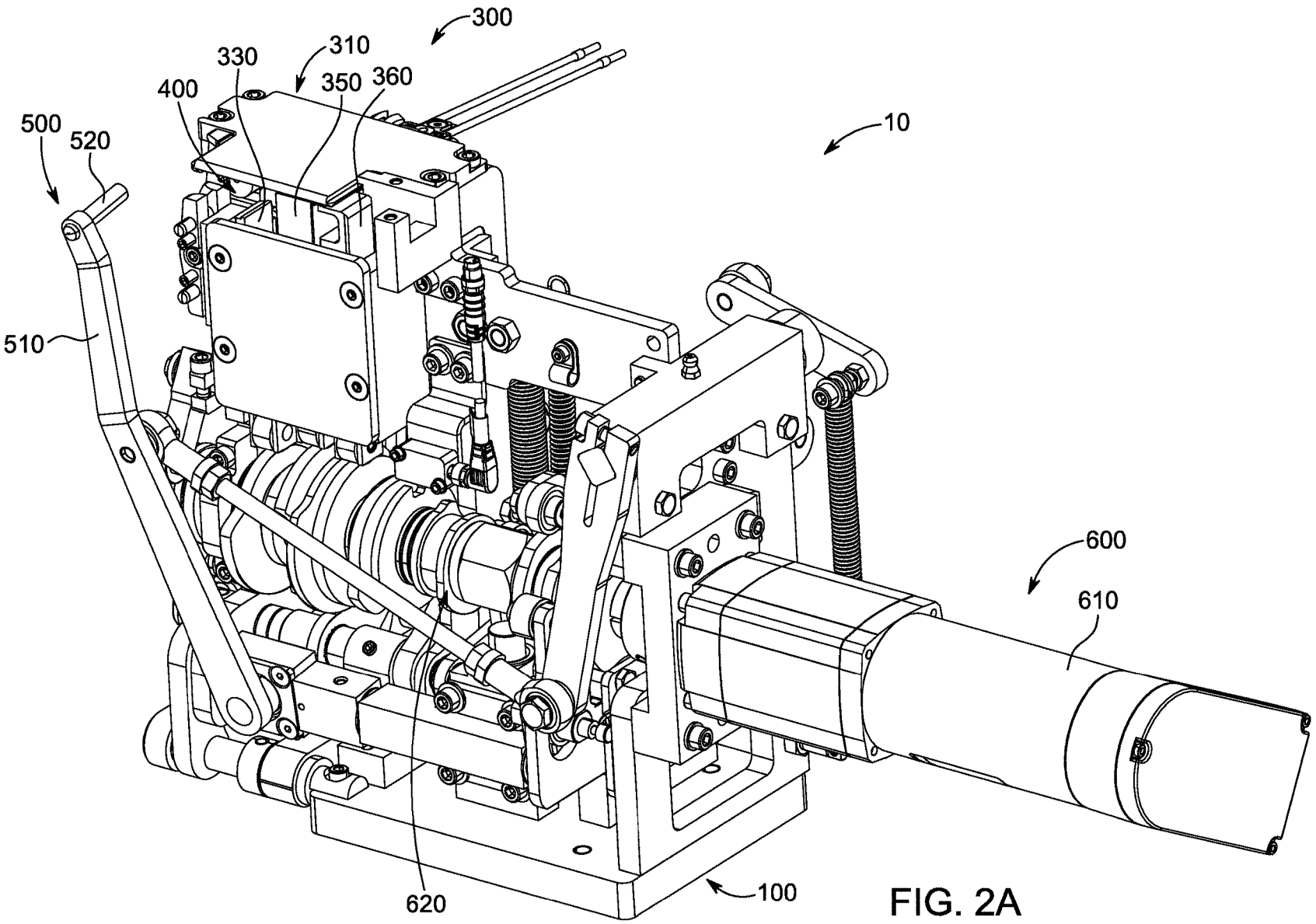
FIG. 2A is a perspective view of the sealing assembly of the strapping machine of FIGS. 1A-1E.
Figure 2B:
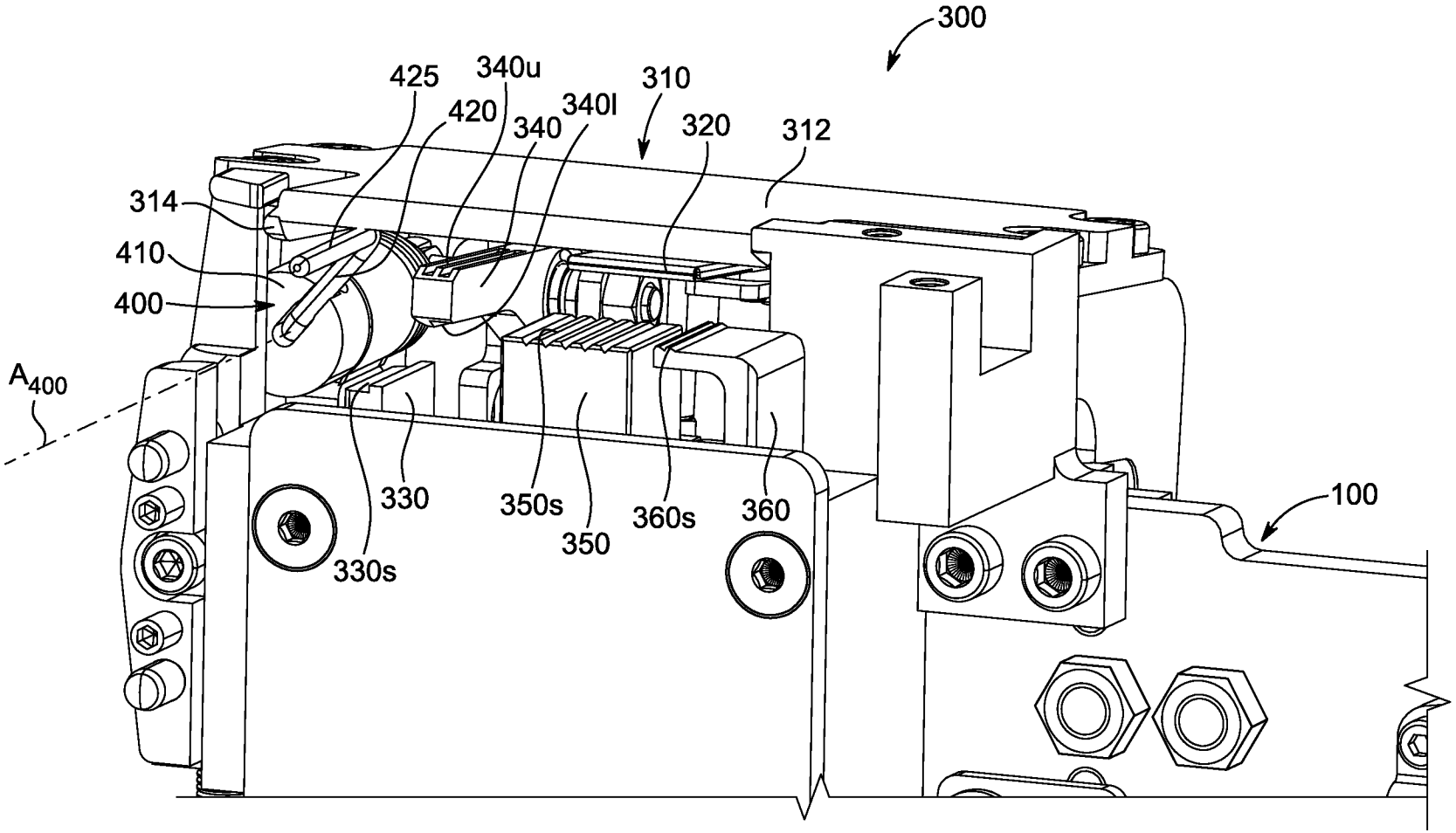
FIG. 2B is a perspective view of the welding assembly of the sealing assembly of FIG. 2A.

The leading-strap-end guide 400, which is best shown in FIG. 2B, includes a cylindrical body 410 having a longitudinal axis $A_{400}$, a strap-engager support 420 extending radially from the body 410, and a strap engager 425 extending transverse to the strap-engager support 420 (and transverse to the longitudinal direction of the strap) such that the strap engager 425 is radially offset from and substantially parallel to the longitudinal axis $A_{400}$. The leading-strap-end guide 400 is rotatable about the longitudinal axis $A_{400}$ and movable along the longitudinal axis $A_{400}$ relative to the other components of the welding assembly 300.

The second strap manipulator 500, which is best shown in FIG. 2A, includes an arm 510 and a finger 520 extending transversely from the arm. The arm 510 and the finger 520 are movable relative to the other components of the welding assembly 300 in three directions (into and out of the page, vertically, and horizontally from the viewpoint shown in FIGS. 3A-3O) via pivoting of the arm 510.

The drive assembly 600, which is best shown in FIG. 2A, drives the welding assembly 300 to manipulate the strap S to form the strap loop around the load. The drive assembly 600 includes an actuator 610 (which may be any suitable actuator such as an electric motor), a camshaft 620 including multiple cams, and multiple actuators (not labeled or shown in detail). The camshaft 620 is rotatably supported by the sealing-assembly frame 100 via suitable bearings such that the camshaft 620 can rotate relative to the sealing-assembly frame 100. The motor 610 is mounted to the sealing-assembly frame 100 and is operably connected to the camshaft 620 (such as via a suitable coupling or a splined or keyed connection) and configured to rotate the camshaft 620 one full rotation (though it may be more than or less than one full rotation in other embodiments) to carry out the strapping cycle. The actuators include suitable components (such as cam followers) that operably connect certain cams on the camshaft 620 to the counter-pressure plate 310, the workpiece 320, the first strap clamp 330, the second strap clamp 340, the third strap clamp 350, the fourth strap clamp 360, the leading-strap-end guide 400, and the second strap manipulator of the welding assembly 300 to move these components as described herein as the camshaft 620 rotates during the strapping cycle. Put differently, the cams are shaped, sized, positioned, oriented, and otherwise configured to manipulate the actuators to drive these components of the welding assembly 300 during the strapping cycle.

More specifically, the drive assembly 600 is operably connected to the counter-pressure plate 310 to move the counter-pressure plate 310 relative to the other components of the welding assembly 300 between a sealing position (FIGS. 2A, 3A-3J, 3N, and 3O) in which the counter-pressure plate is between the strap clamps and the load and a retracted position (FIGS. 2B and 3K-3M) in which the counter-pressure plate is not between the strap clamps and the load. The drive assembly 600 is operably connected to the workpiece 320 to move the workpiece 320 relative to the other components of the welding assembly 300 between a sealing position (FIGS. 3E-3H) in which the workpiece 320 is between the counter-pressure plate 310 and the third strap clamp 350 and a retracted position (FIGS. 2A-3D and 3I-3O) in which the workpiece 320 is not between the counter-pressure plate 310 and the third strap clamp 350. The drive assembly 600 is operably connected to the first strap clamp 330 to move the first strap clamp 330 toward and away from the counter-pressure plate 310 and relative to the other components of the welding assembly 300. The drive assembly 600 is operably connected to the second strap clamp 340 to move the second strap clamp 340 toward and away from the counter-pressure plate 310 and relative to the other components of the welding assembly 300. The drive assembly 600 is also operably connected to the second strap clamp 340 to move the second strap clamp 340 from a position above the first strap clamp 330 to a position removed from the first strap clamp 330 and relative to the other components of the welding assembly 300. The drive assembly 600 is operably connected to the third strap clamp 350 to move the third strap clamp 350 toward and away from the counter-pressure plate 310 and relative to the other components of the welding assembly 300. The drive assembly 600 is operably connected to the fourth strap clamp 360 to move the fourth strap clamp 360 toward and away from the counter-pressure plate 310 and relative to the other components of the welding assembly 300.

The controller includes a processing device (or devices) communicatively connected to a memory device (or devices). For instance, the controller may be a programmable logic controller. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the strapping machine 1. The controller is communicatively and operably connected to the motor 610 and configured to receive signals from and to control the motor 610. The controller is also communicatively and operably connected to the heating element and configured to control the heating element to heat the workpiece 320. The controller may also be communicatively connectable (such as via Wi-Fi, Bluetooth, near-field communication, or other suitable wireless communications protocol) to an external device, such as a computing device, to send information to and receive information from that external device.

Figure 3A:
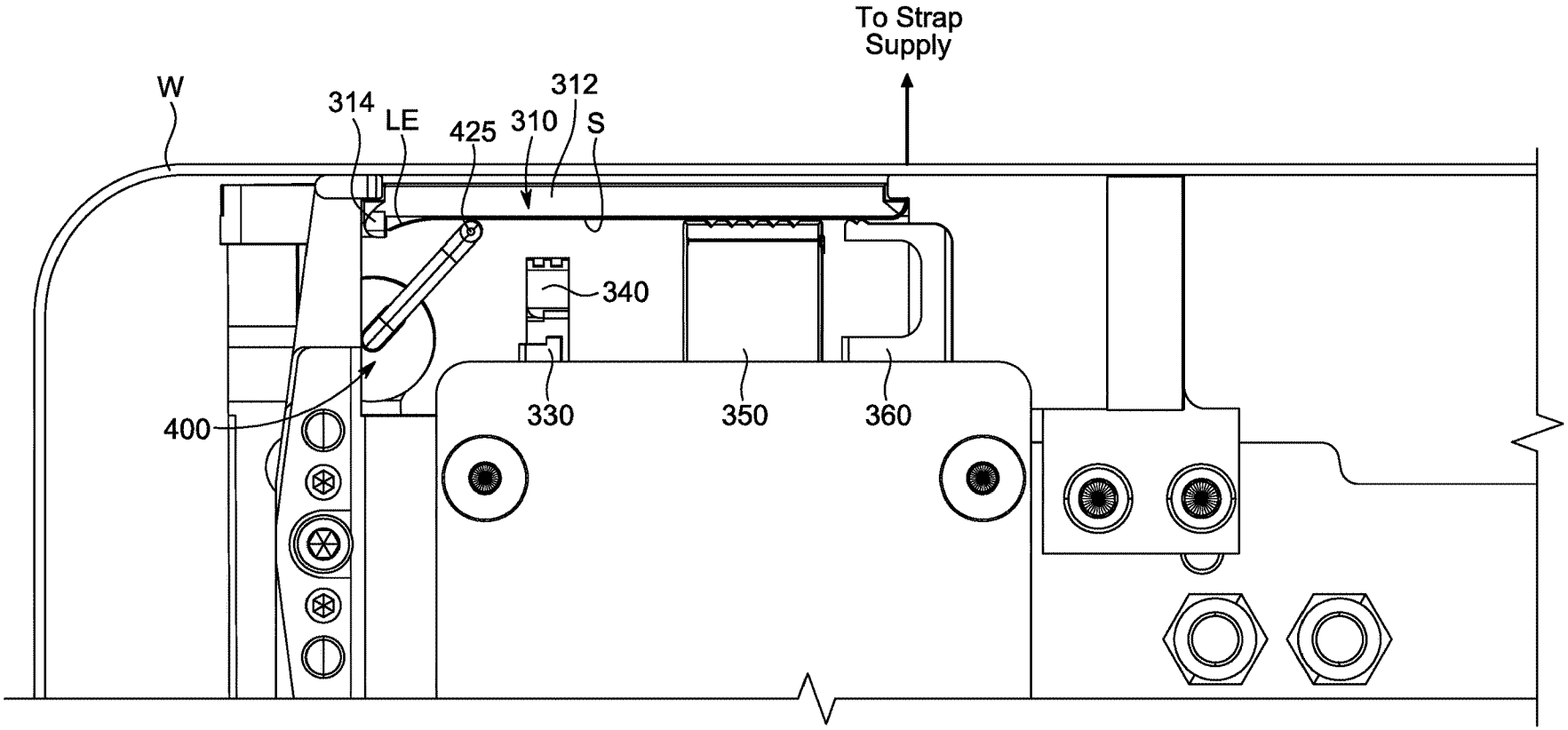
FIGS. 3A-3O are side views of part of the welding assembly of FIG. 2B during various stages of a strapping cycle.
Figure 3B:
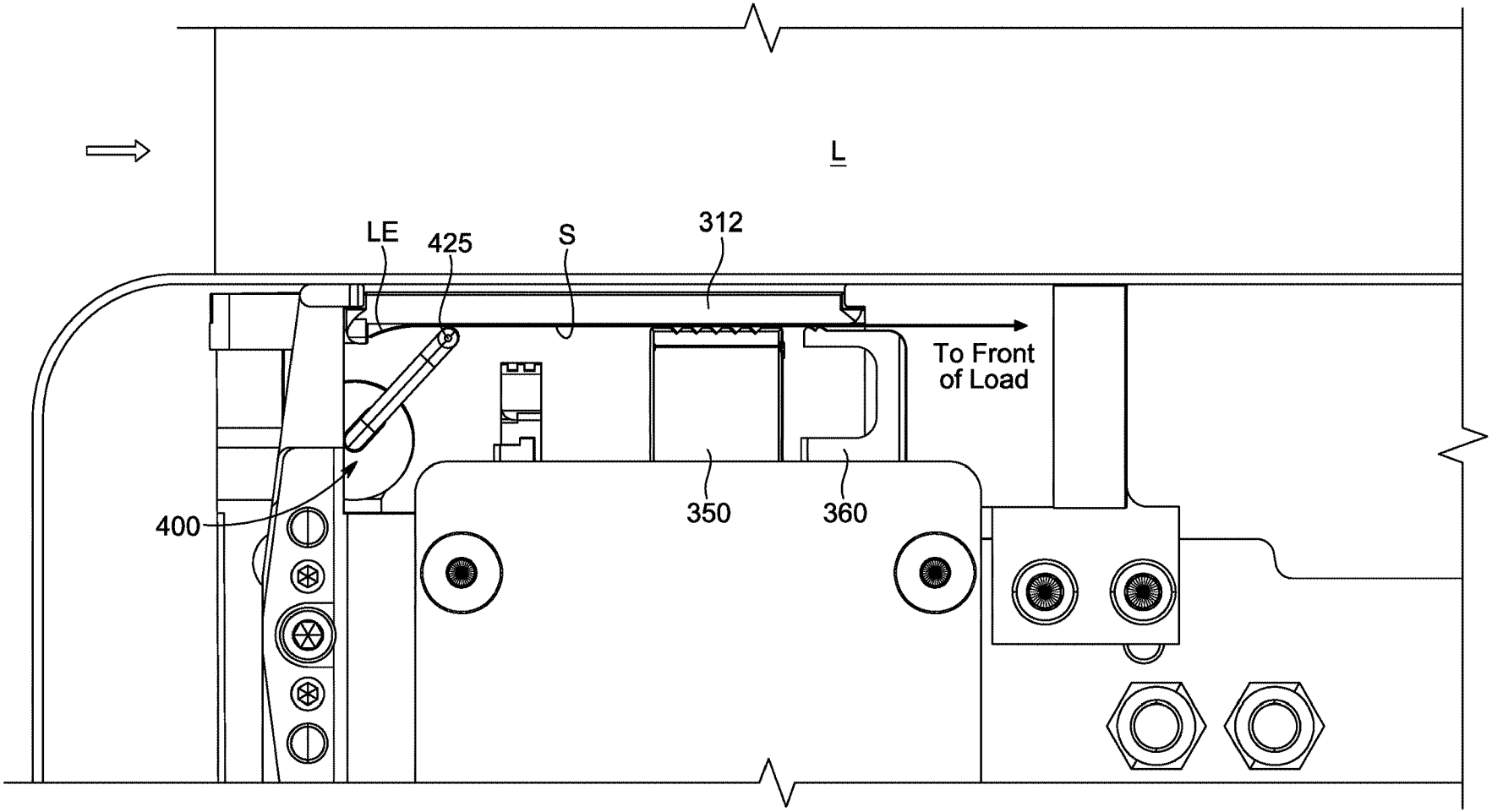
Figure 3C:
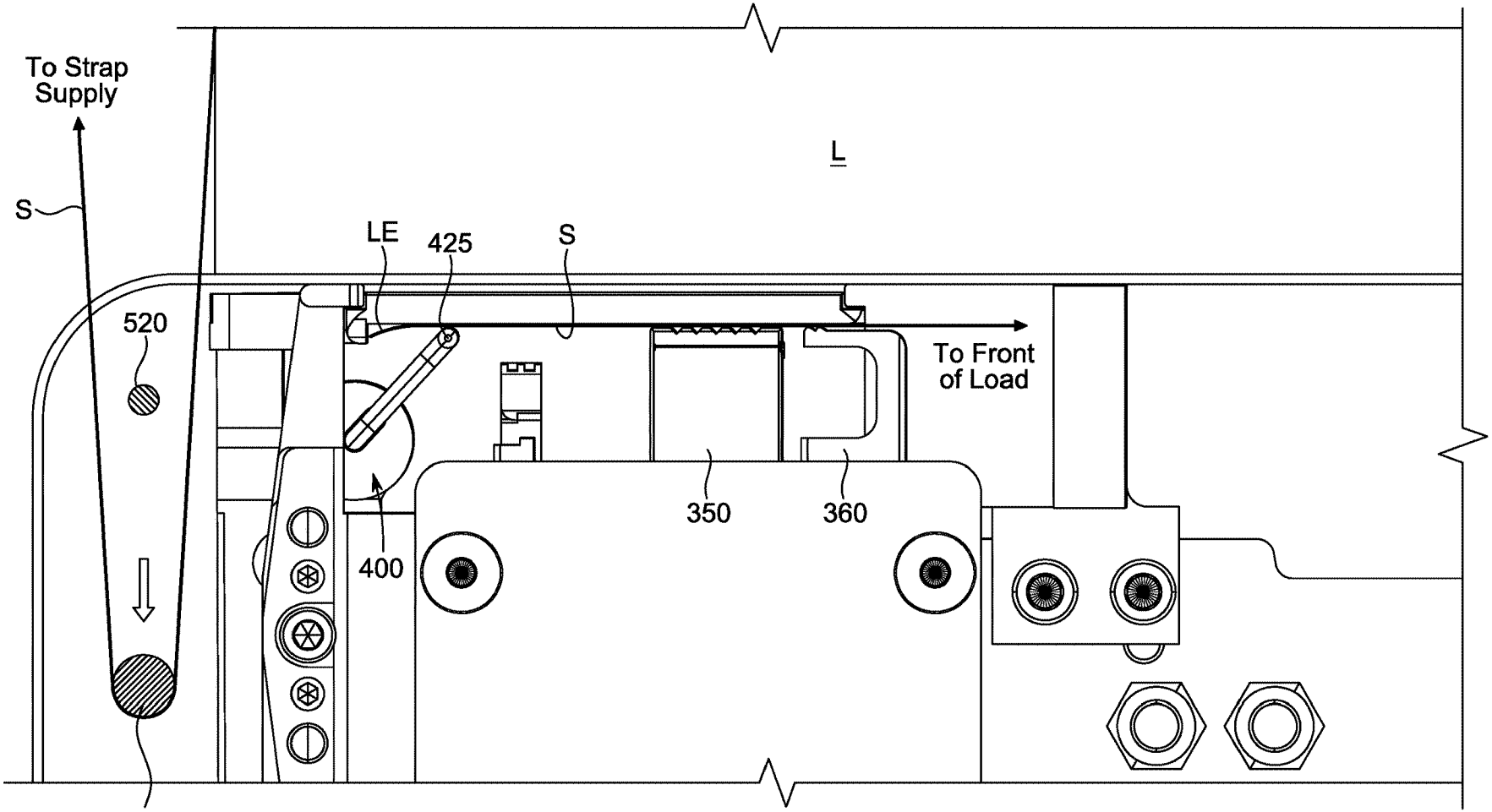
Figure 3D:
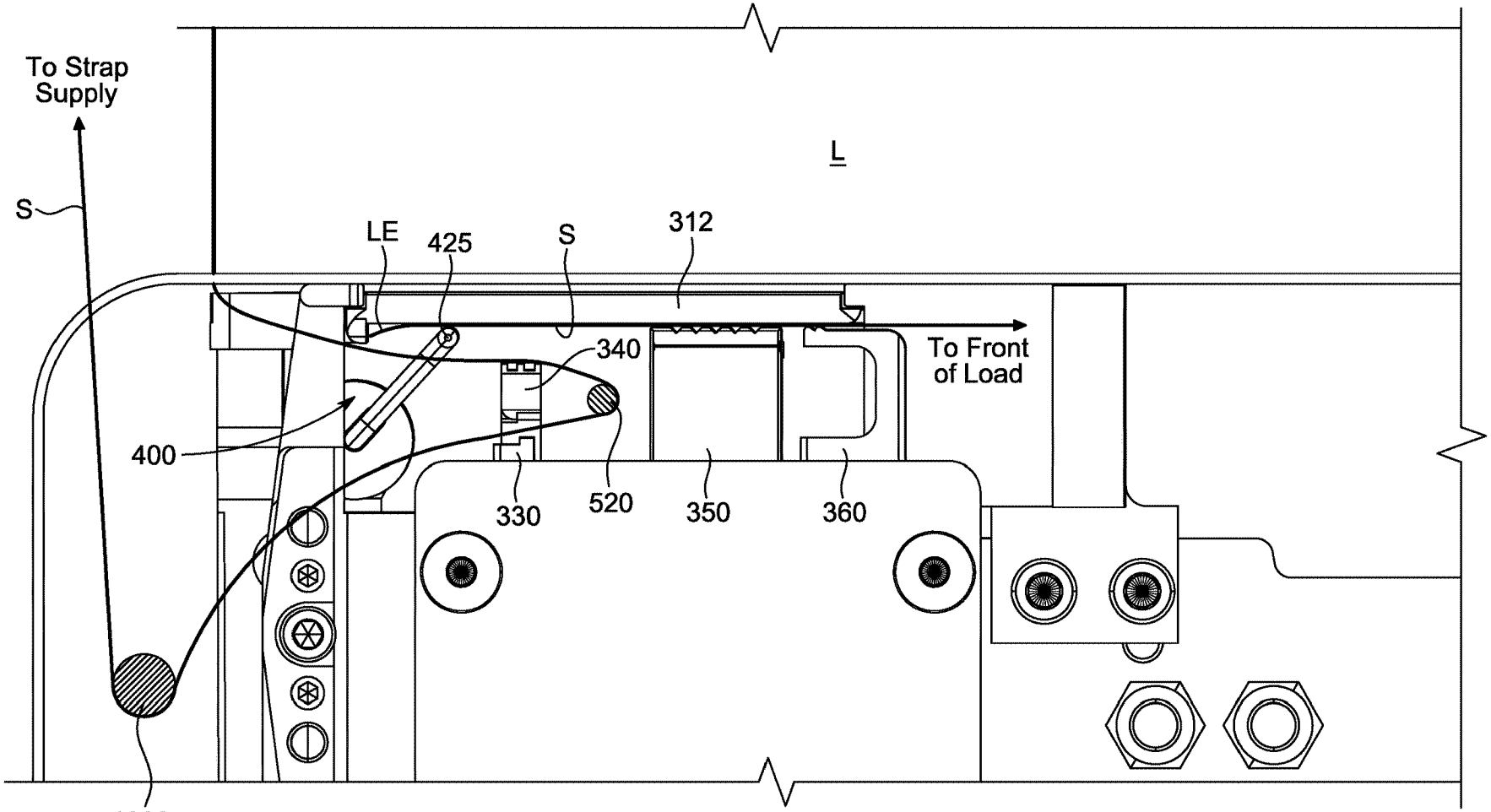
Figure 3E:
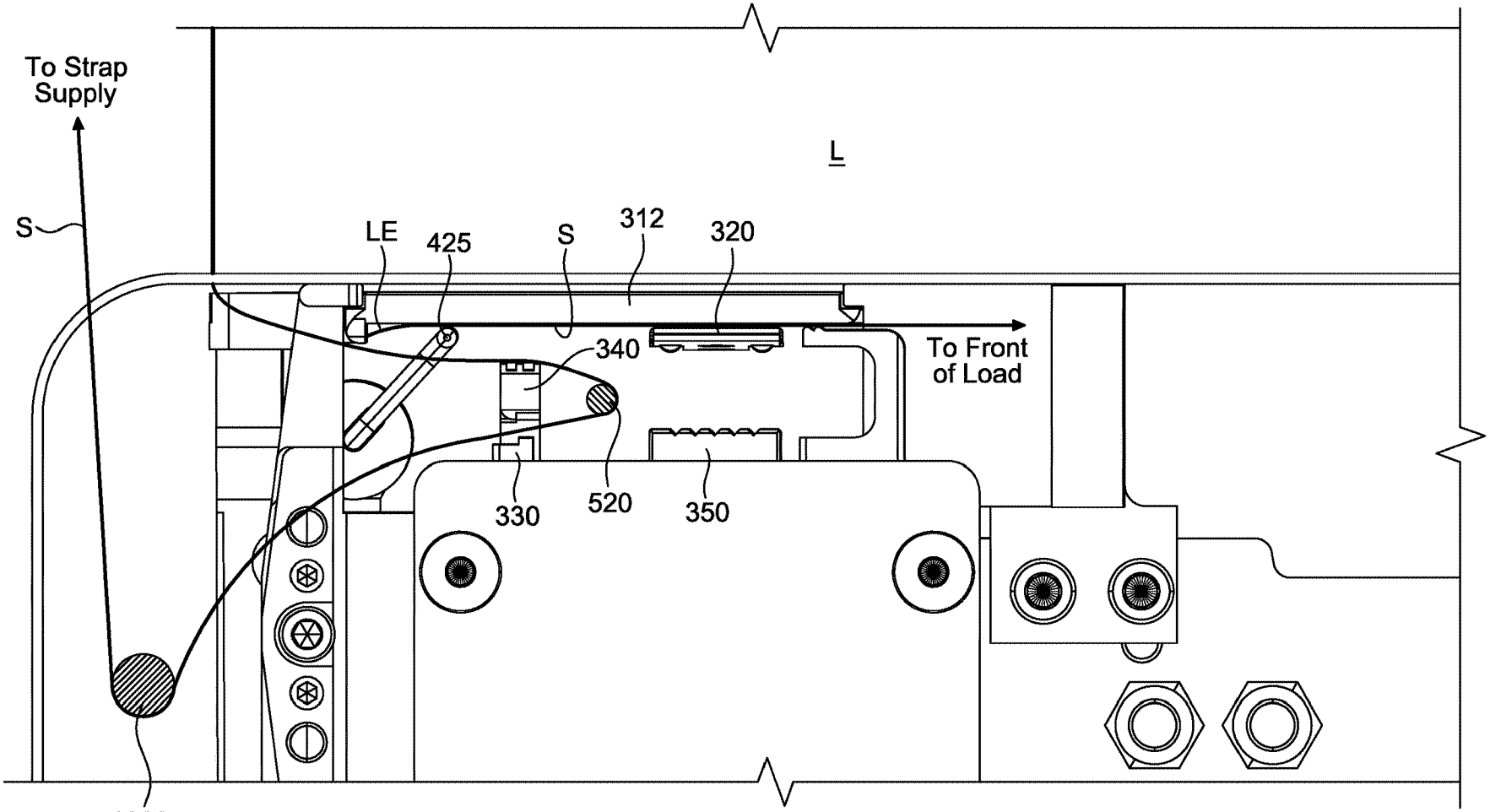
Figure 3F:
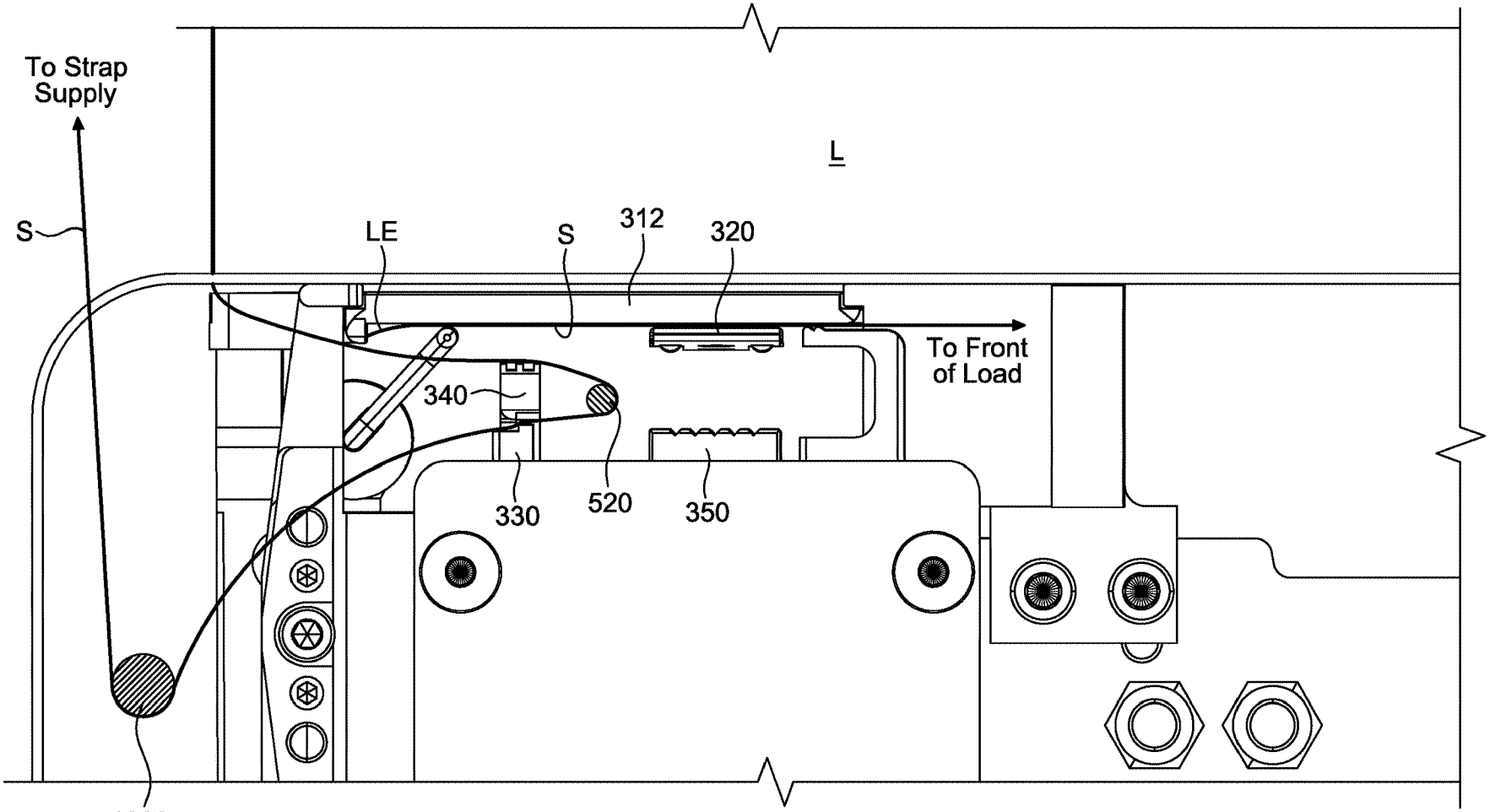
Figure 3G:
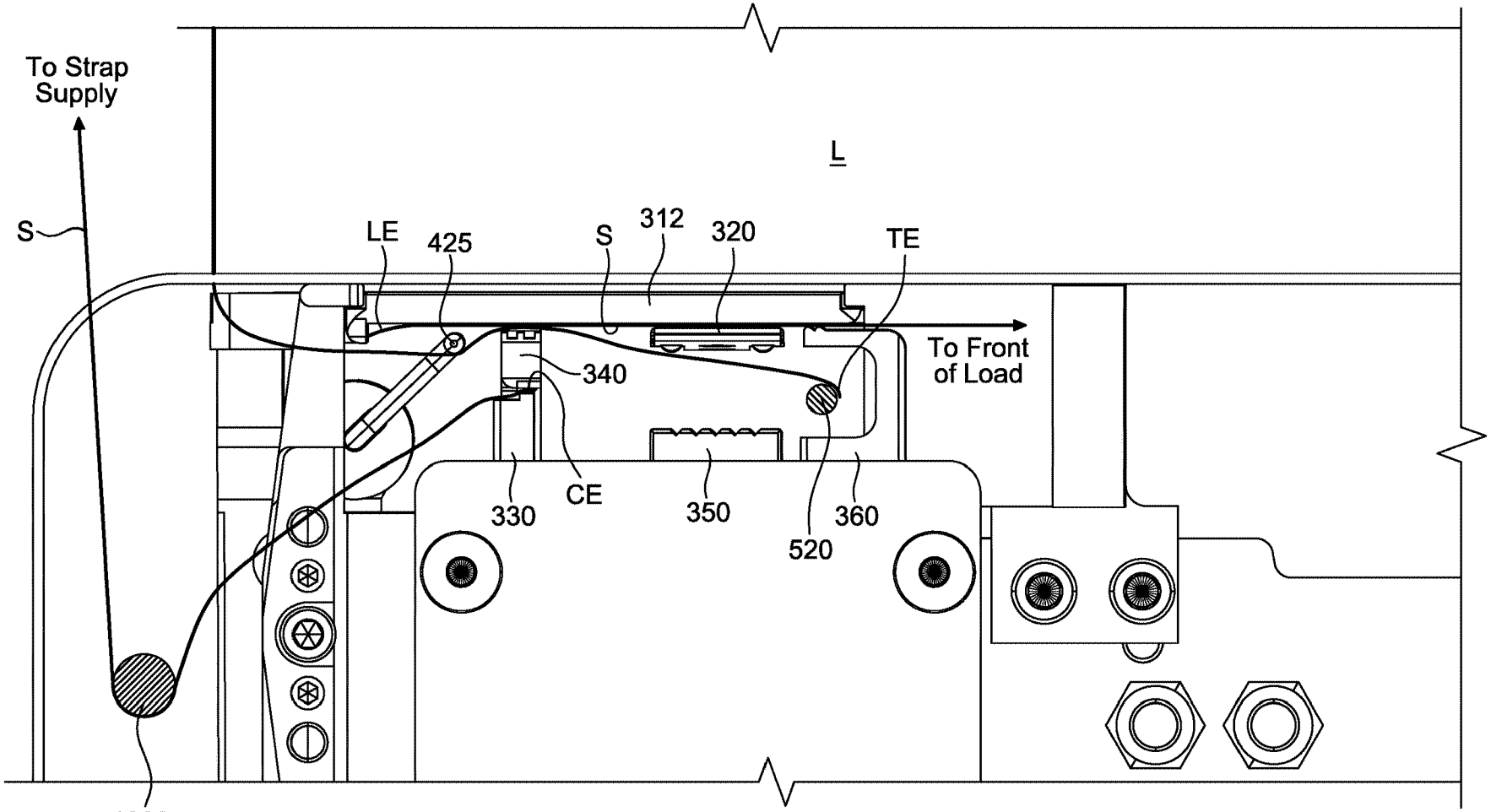
Figure 3H:
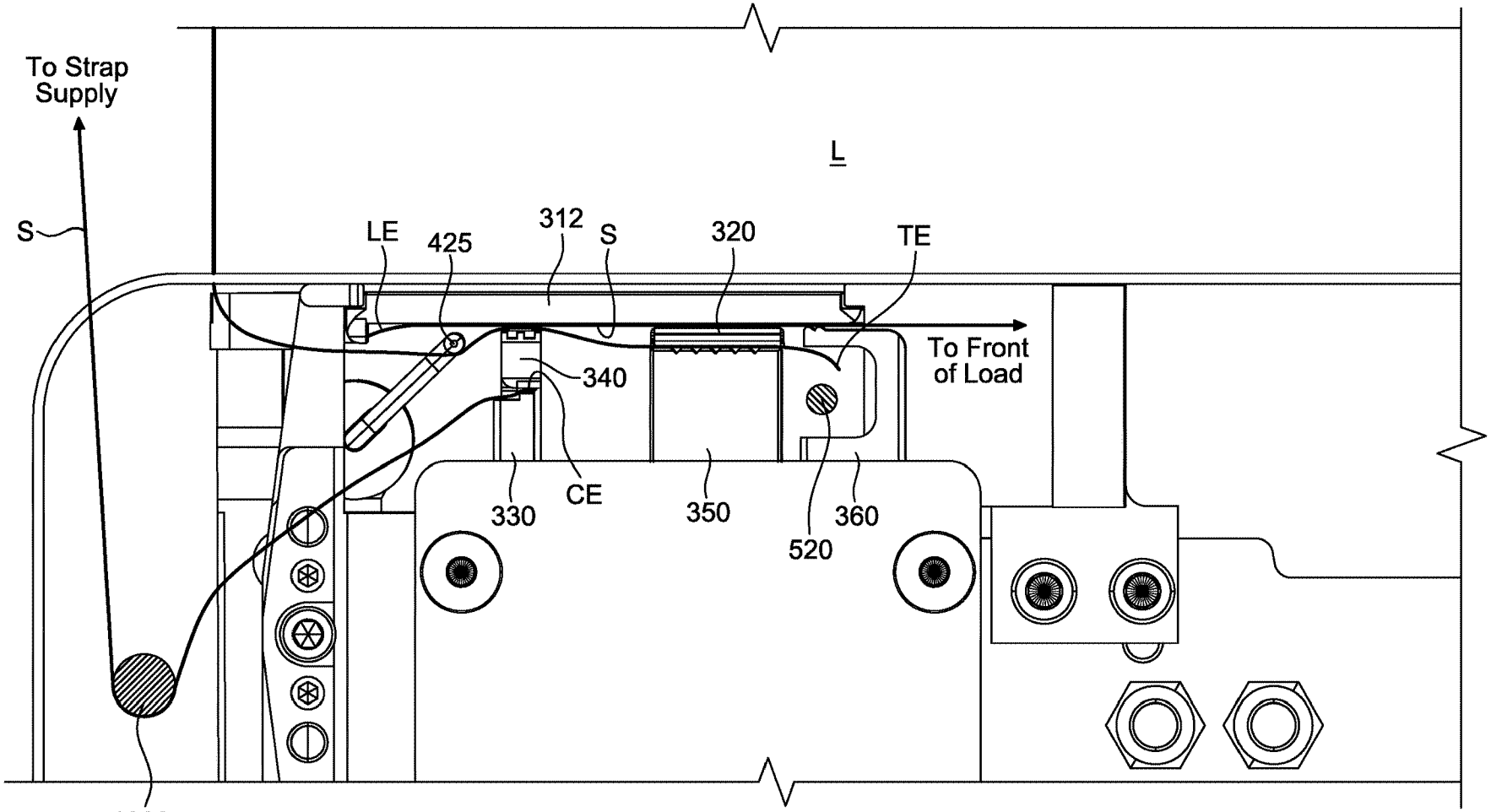
Figure 3I:
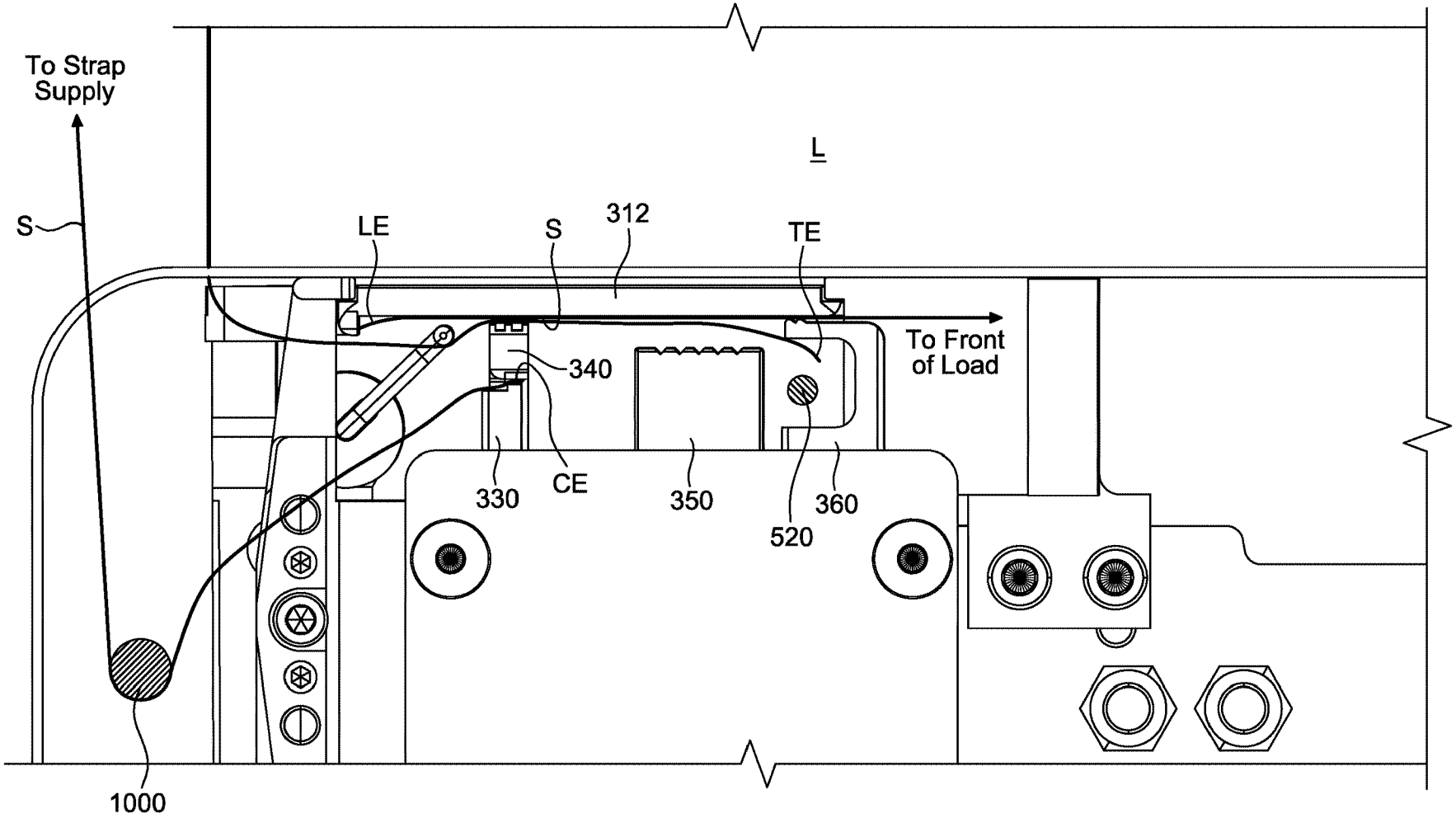
Figure 3J:
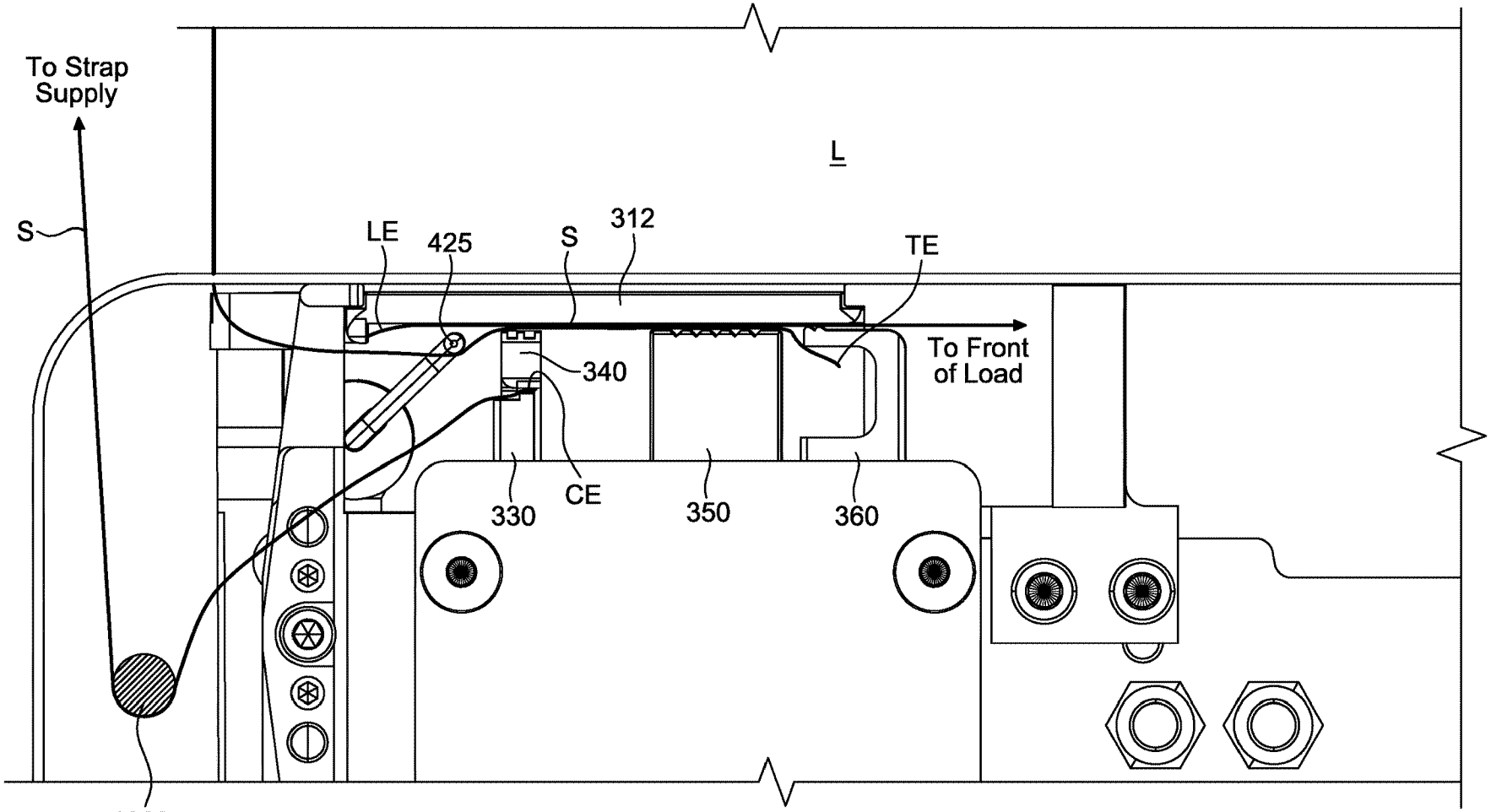
Figure 3K:
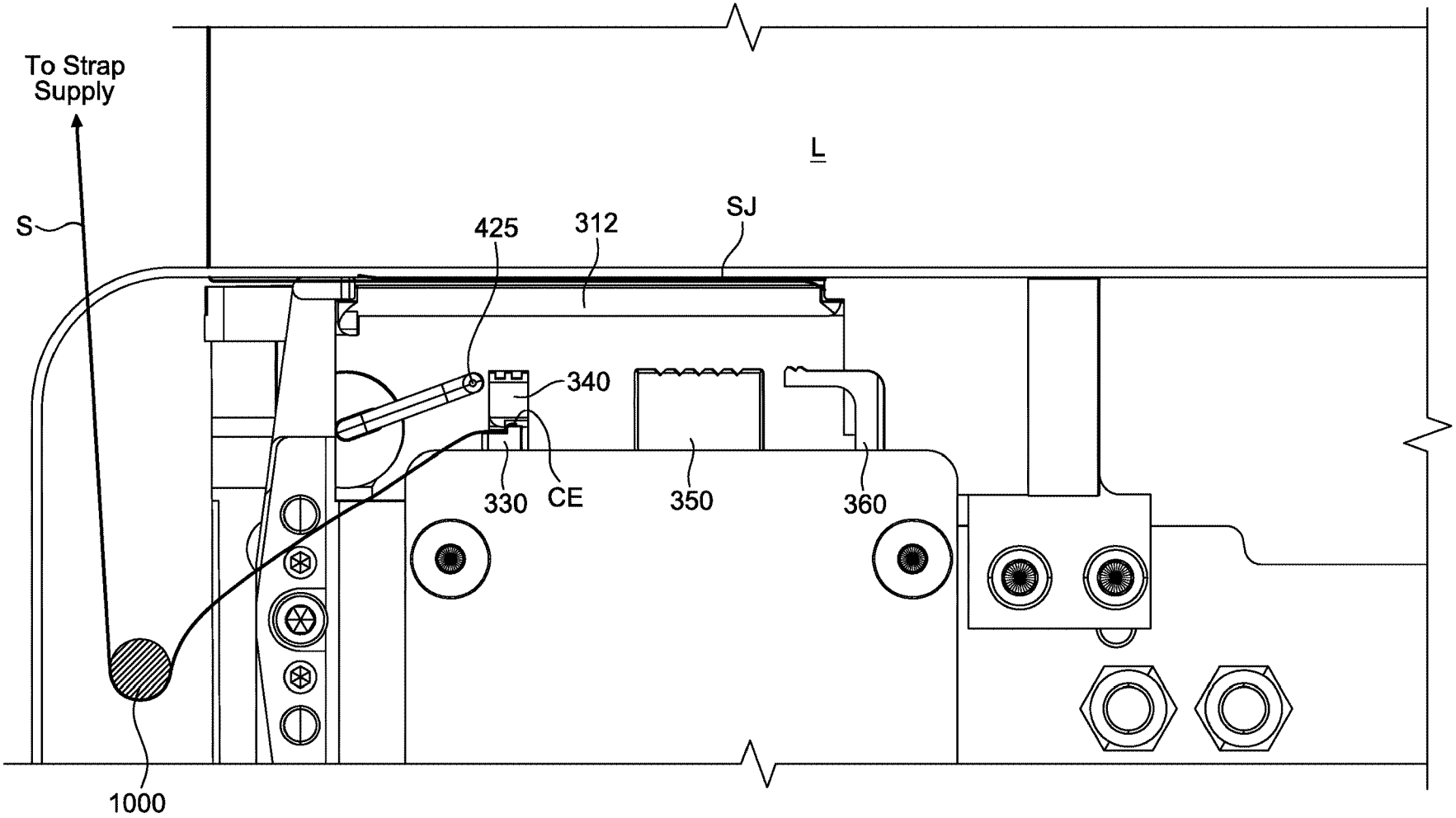
Figure 3L:
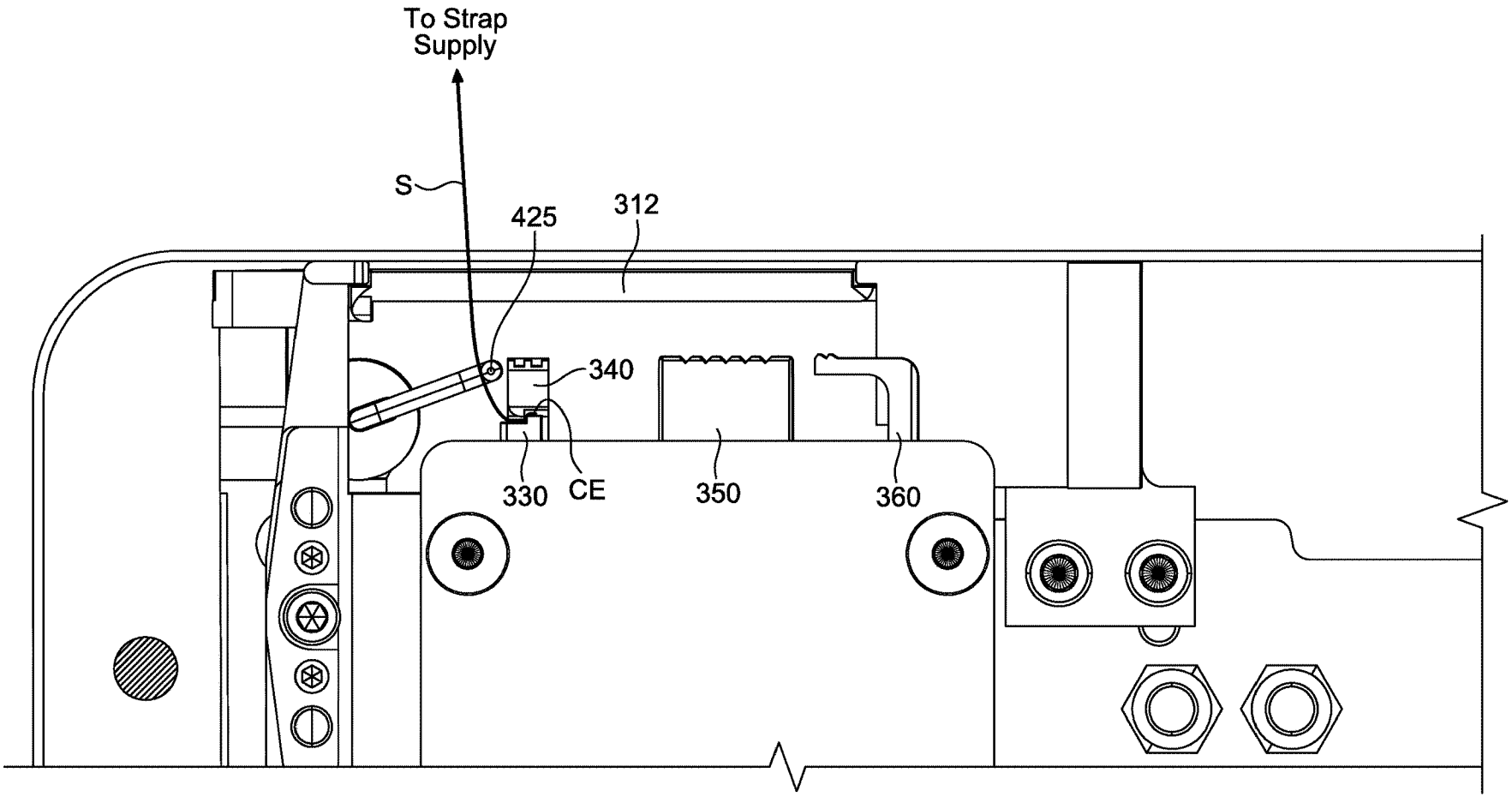
Figure 3M:
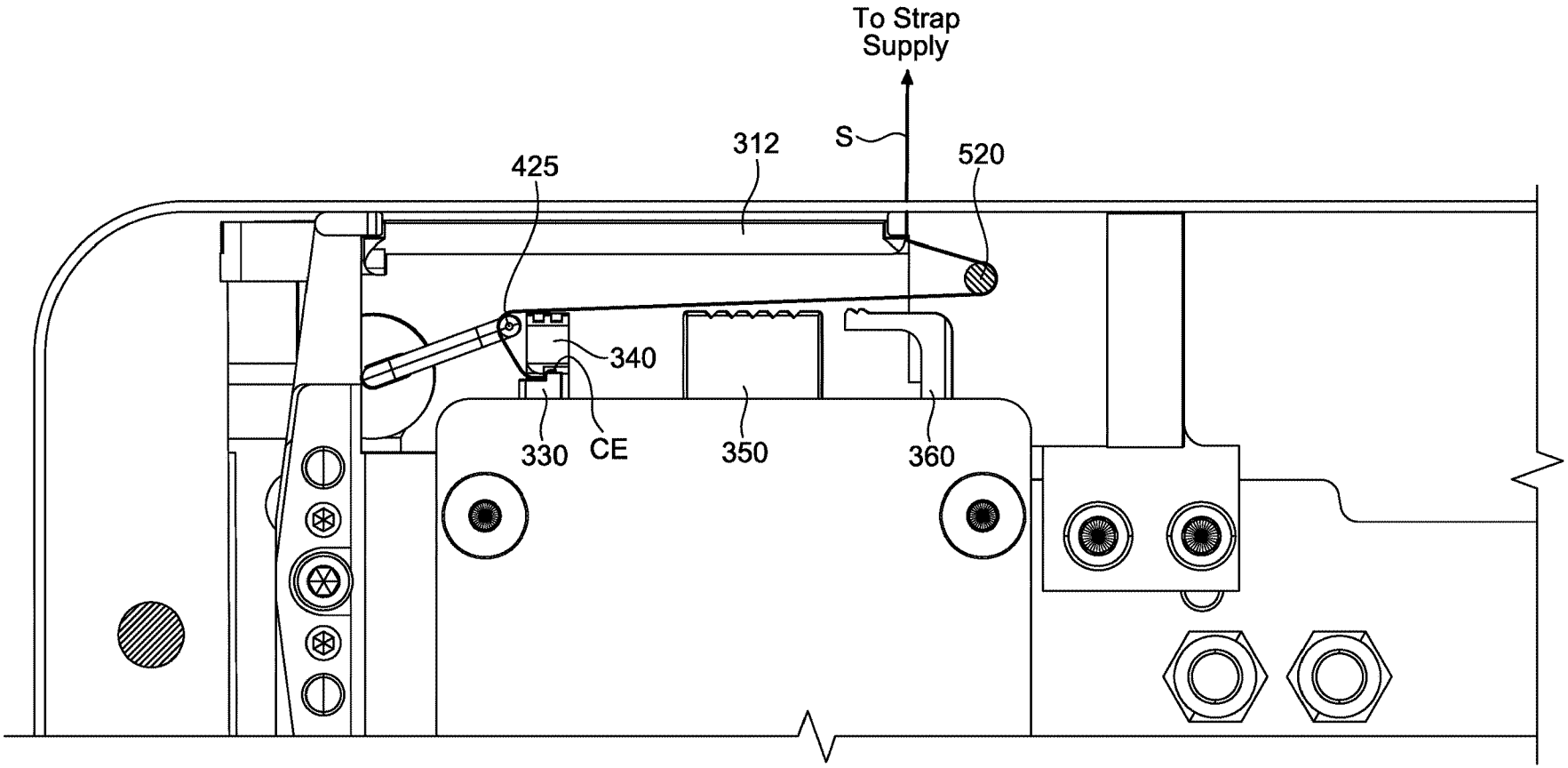
Figure 3N:
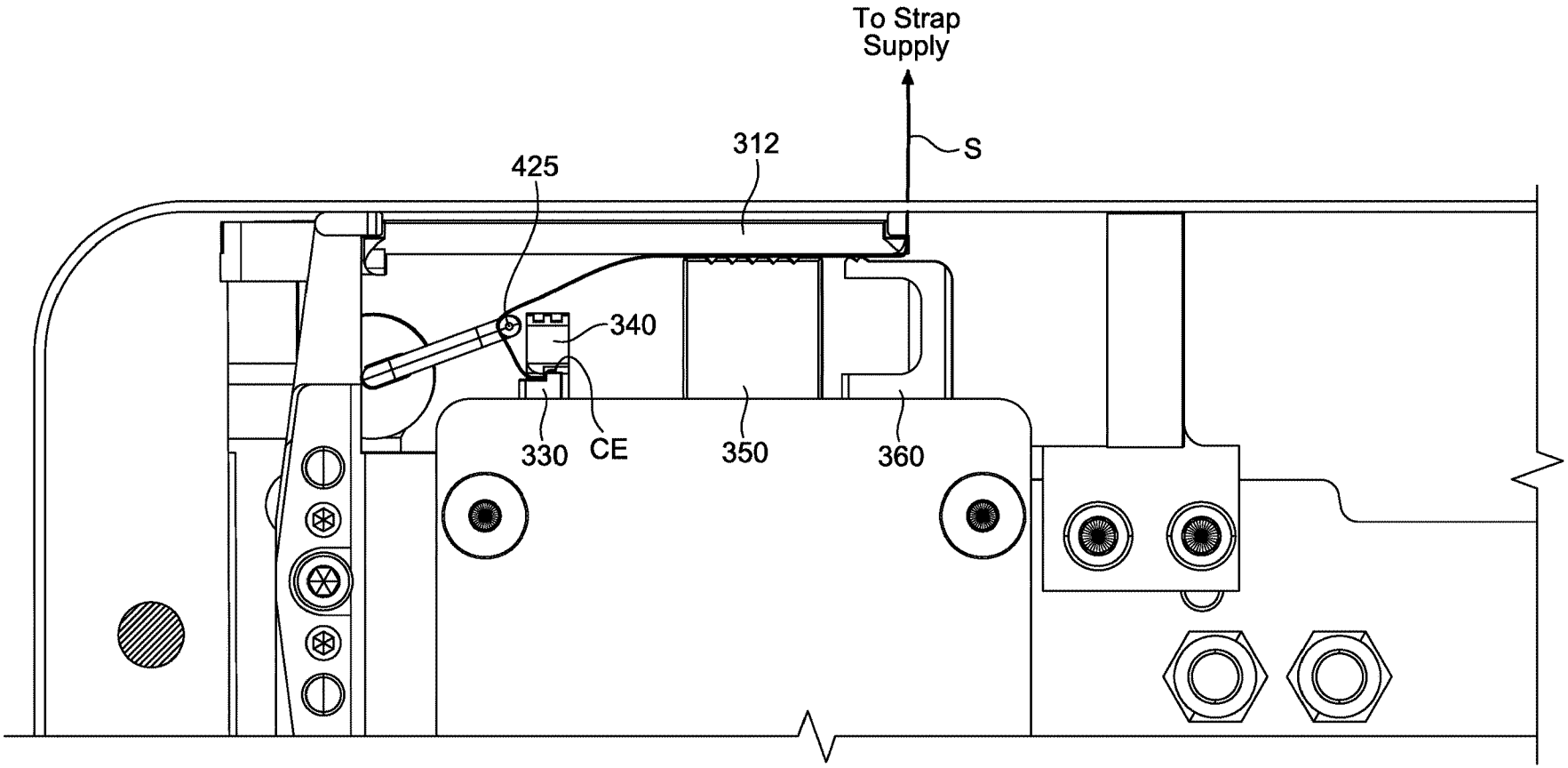
Figure 3O:
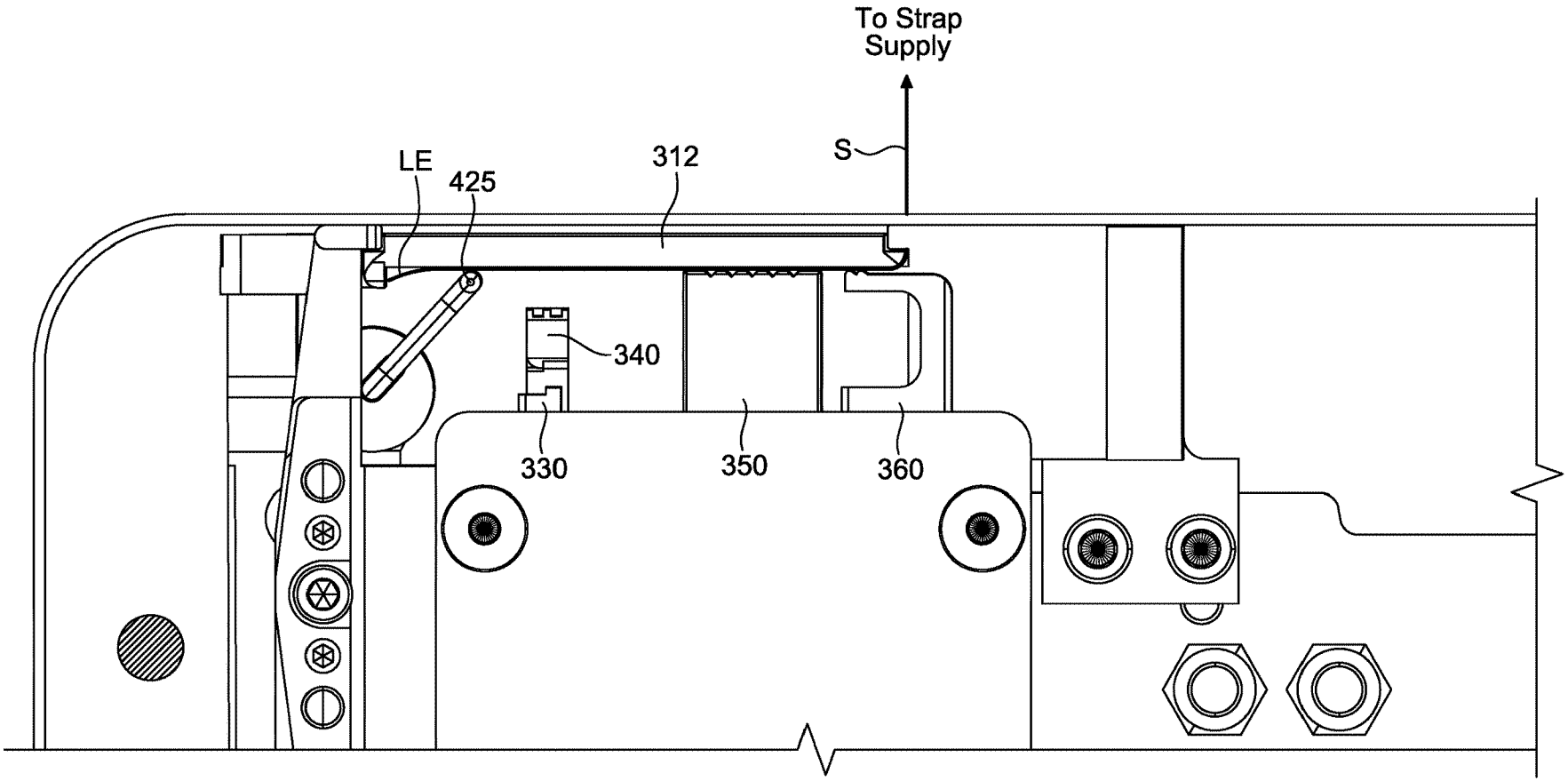

FIGS. 3A-3O show certain components of the welding assembly 300 for an example strapping cycle during which a loop of strap S is formed around a load L. Initially, as shown in FIG. 3A, the counter-pressure plate 310 is in its sealing position, and the workpiece 320 is in its retracted position. The strap S extends from its leading end LE adjacent the lip 314 of the counter-pressure plate 310 along the underside of the body 312 of the counter-pressure plate 310 and up through an opening (not shown) in the work platform W to the strap supply 900 (not shown in FIGS. 3A-3O). The third strap clamp 350, the fourth strap clamp 360, and the strap engager 425 of the leading-strap-end guide 400 clamp the strap S against the underside of the body 312 of the counter-pressure plate 310 to prevent the strap from moving and misaligning when the load L contacts the strap S as it moves to the welding position. The second strap manipulator 520 is retracted at this point and therefore not shown in FIG. 3A.

FIG. 3B shows the welding assembly 300 after the load L has been introduced into the strapping machine 1 atop the work platform W and has moved to the welding position shown in FIG. 1C. The third strap clamp 350, the fourth strap clamp 360, and the strap engager 425 of the leading-strap-end guide 400 continue to clamp the strap S against the underside of the body 312 of the counter-pressure plate 310, and the strap S extends from the clamps along part of the lower surface of the load L, along the leading surface (not shown) of the load L, and along the top surface (not shown) of the load L.

FIG. 3C shows the welding assembly 300 after the first strap manipulator 1000 has descended to its sealing position below the work platform W and adjacent the sealing assembly 10, as shown in FIG. 1D, and after the second strap manipulator 500 has moved the finger 520 between the two portions of the strap extending from the first strap manipulator 1000. The third strap clamp 350, the fourth strap clamp 360, and the strap engager 425 of the leading-strap-end guide 400 continue to clamp the strap S against the underside of the body 312 of the counter-pressure plate 310, and the strap S extends from the clamps along part of the lower surface of the load L, along the leading surface (not shown) of the load L, along the top surface (not shown) of the load L, and along the trailing surface (partially shown) of the load L.

FIG. 3D shows the welding assembly 300 after the finger 520 has moved to a position between the first and second strap clamps 330 and 340 and the third strap clamp 350. As the finger 520 moves toward this position, it engages the strap S extending from the first strap manipulator 1000 and pulls the strap S with it such that the strap S extends from the first strap manipulator 1000 across the clamping surface 330*s* of the first strap clamp 330 and to the finger 520. The lip 314 of the counter-pressure plate 310 shields the leading end LE from being contacted by the strap S pulled by the second strap manipulator 500, which (along with the fact that the strap S is clamped against the underside of the body 312) prevents the strap from misaligning during this manipulation. The third strap clamp 350, the fourth strap clamp 360, and the strap engager 425 of the leading-strap-end guide 400 continue to clamp the strap S against the underside of the body 312 of the counter-pressure plate 310, and the strap S extends from the clamps along part of the lower surface of the load L, along the leading surface (not shown) of the load L, along the top surface (not shown) of the load L, and beneath the leading end LE.

FIG. 3E shows the welding assembly 300 after the second strap clamp 340 has moved to a position between the portions of the strap S extending from the finger 520, the third strap clamp 350 has descended to release part of the strap S, and the workpiece 320 has moved to its sealing position. The fourth strap clamp 360 and the strap engager 425 of the leading-strap-end guide 400 continue to clamp the strap S against the underside of the body 312 of the counter-pressure plate 310, and the strap S extends along part of the lower surface of the load L, along the leading surface (not shown) of the load L, along the top surface (not shown) of the load L, and beneath the leading end LE. Part of the strap extending along the underside of the body 312 of the counter-pressure plate 310 is between the body 312 and the workpiece 320.

FIG. 3F shows the welding assembly 300 after the first strap clamp 330 has ascended to clamp a portion of the strap S between the clamping surface 330*s* of the first strap clamp 330 and the lower clamping surface 3401 of the second strap clamp 340. The fourth strap clamp 360 and the strap engager 425 of the leading-strap-end guide 400 continue to clamp the strap S against the underside of the body 312 of the counter-pressure plate 310, and the strap S extends along part of the lower surface of the load L, along the leading surface (not shown) of the load L, along the top surface (not shown) of the load L, and beneath the leading end LE.

FIG. 3G shows the welding assembly 300 after the first and second strap clamps 330 and 340 have ascended to clamp a portion of the strap S between the upper clamping surface 340*u* of the second strap clamp 340 and the underside of the body 312 of the counter-pressure plate 310, a cutting device (not shown) has cut the strap S to create a trailing strap end TE and a cut strap end CE that remains clamped between the first and second strap clamps, the finger 520 has moved to a position within a cutout of the fourth strap clamp 360 to direct the trailing strap end TE across the third strap clamp 350 and below the workpiece 320, and the leading-strap-end guide 400 has rotated about the longitudinal axis $A_{400}$ to release the leading end LE and has moved longitudinally to a retracted longitudinal position. At this point, one portion of the strap adjacent the leading strap end LE is positioned between the workpiece 320 and the underside of the counter-pressure plate and another portion of the strap adjacent the trailing strap end TE is positioned between the workpiece 320 and the clamping surface 350*s* of the third strap clamp 350.

FIG. 3H shows the welding assembly 300 after the third strap clamp 350 has ascended to clamp a portion of the strap S between the clamping surface 350*s* of the third strap clamp 350 and the workpiece 320 and another portion of the strap S between the workpiece 320 and the underside of the body 312 of the counter-pressure plate 310 and after the heating element has been activated to heat the workpiece 320 to melt the portions of the strap clamped against the workpiece 320.

FIG. 3I shows the welding assembly 300 after the third strap clamp 350 has descended to release the portions of the strap and workpiece 320 has moved to its home position.

FIG. 3J shows the welding assembly 300 after the third strap clamp 350 has ascended to clamp the melted portions of the strap against one another and against the underside of the body 312 of the counter-pressure plate 310. This attaches the portions of the strap to one another and forms the strap loop around the load L. The second strap manipulator 520 has also been retracted.

FIG. 3K shows the welding assembly 300 after the first, second, third, and fourth strap clamps 330, 340, 350, and 360 have descended to release the strap S and the counter-pressure plate 310 has moved to its retracted position to release the strap loop to enable the load L to be removed from the strapping machine 1. The leading-strap-end guide 400 has also rotated to bring the strap engager 425 closer to the first and second strap clamps 330 and 340 and the cut end CE of the strap clamped between those components and has moved longitudinally from its retracted position back to its forward position shown in FIG. 3A.

FIG. 3L shows the welding assembly 300 after the load L has been removed from the strapping machine 1 and the first strap manipulator 1000 has ascended back to its home position. At this point, the cut end CE of the strap-which will be the leading strap end for the next strapping cycle-continues to be clamped between the first and second strap clamps 330 and 340. The ascension of the first strap manipulator 1000 caused part of the strap S extending from the cut strap end CE to partially wrap around strap engager 425 of the leading-strap-end guide 400.

At this point, the welding assembly 300 manipulates the strap to position it for the next strapping cycle, and in particular to position it beneath and clamp it to the counter-pressure plate 310 so the next load does not misalign the strap (potentially fouling the sealing process) when moving across the work surface W. FIG. 3M shows the welding assembly 300 after the finger 520 of the second strap manipulator has moved to direct the strap around the strap engager 425 and across the upper clamping surface 340*u* of the second strap clamp 340, the clamping surface 350*s* of the third strap clamp 350, and the clamping surface 360*s* of the fourth strap clamp 360.

FIG. 3N shows the welding assembly 300 after the counter-pressure plate has moved back to its sealing position and the third and fourth strap clamps 350 and 360 have ascended to clamp part of the strap against the underside of the body 312 of the counter-pressure plate 310.

FIG. 3O shows the welding assembly 300 after the first and second strap clamp 330 and 340 have moved to release the leading-end-guide 400 has rotated such that the strap engager 425 clamps the cut strap end CE against the underside of the body 312 of the counter-pressure plate 310. If the cut strap end CE gets stuck on one of or between the first and second strap clamps 330 and 340, the rotating strap engager 425 pulls the leading strap end LE from between the clamps as it rotates. At this point, the strap is clamped to the underside of the body 312 of the counter-pressure plate at three places by three different components (the strap engager 425, the third strap clamp 350, and the fourth strap clamp 360), ensuring that the strap remains in place and aligned properly during the next strapping cycle.

The position of the leading-strap-end guide, and particularly the strap engager, relative to the strap before the first and second strap clamps and release the cut strap end ensures the strap engager can engage the leading strap end or a portion of the strap adjacent the leading strap end (to the extent needed) during the entire rotation. Certain known welding assemblies rely on the strap "springing" out of vertically movable strap clamps into a particular position to enable a vertically translating leading-strap-end clamp to clamp the leading end onto the counter-pressure plate. If the strap does not "spring" into place as expected, these known leading-strap-end clamps miss the strap and do not clamp it against the counter-pressure plate, which means no strap loop is formed around the load. The leading-strap-end guide of the present disclosure solves this problem by being positioned and configured to, if needed, guide the leading strap end up to the counter-pressure plate.

In other embodiments, rather than being rotatable to move the strap engager to guide the leading strap end to the counter-pressure plate and to clamp the leading strap end against the counter-pressure plate, the leading-strap-end guide is translatable (similar to the strap clamps).

The invention claimed is:

1. A strapping machine comprising:

a frame; and a sealing assembly supported by the frame and comprising:

a welding assembly comprising:

a counter-pressure plate;

a first strap clamp;

a second strap clamp;

a third strap clamp;

a strap manipulator; and a leading-strap-end guide comprising a strap engager, wherein the counter-pressure plate is movable between a sealing position in which the counter-pressure plate covers the strap engager, the first strap clamp, the second strap clamp, and the third strap clamp and a retracted position in which the counter-pressure plate does not cover the strap engager, the first strap clamp, the second strap clamp, and the third strap clamp; and a drive assembly configured to, after an end of a strap is clamped between the first and second strap clamps:

cause the strap manipulator to engage and move the strap such that the strap extends around the strap engager and extends across the third strap clamp;

after causing the strap manipulator to engage and move the strap such that the strap extends around the strap engager and extends across the third strap clamp, cause the counter-pressure plate to move from the retracted position to the sealing position;

cause the third strap clamp to move to clamp a first portion of the strap against the counter-pressure plate;

cause the first and second strap clamps to release the strap end; and cause the leading-strap-end guide to move such that the strap engager clamps a second portion of the strap adjacent the strap end against the counter-pressure plate.

2. The strapping machine of claim 1, wherein the leading-strap-end guide is rotatable and the drive assembly is configured to cause the leading-strap-end guide to rotate such that the strap engager clamps the second portion of the strap against the counter-pressure plate.

3. The strapping machine of claim 1, further comprising a fourth strap clamp, wherein the drive assembly is further configured to cause the strap manipulator to engage and move the strap such that the strap extends around the strap engager and extends across the third and fourth strap clamps and to cause the fourth strap clamp to move to clamp a third portion of the strap against the counter-pressure plate.

4. The strapping machine of claim 1, wherein the drive assembly comprises a camshaft and a motor operably connected to the camshaft to rotate the camshaft, wherein the camshaft is operably connected to and configured to move the first strap clamp, the second strap clamp, and the third strap clamp.

5. The strapping machine of claim 4, wherein the camshaft is operably connected to and configured to move the strap manipulator and the leading-strap-end guide.

6. The strapping machine of claim 1, wherein the drive assembly is configured to cause the strap manipulator to engage and move the strap after a strapped load has been removed from the counter-pressure plate.

7. The strapping machine of claim 1, wherein the drive assembly is configured to cause the first and second strap clamps to release the strap end by causing at least the second strap clamp to move.

8. The strapping machine of claim 1, wherein the counter-pressure plate comprises a downwardly extending lip adjacent the leading-strap-end engager.

9. A method of operating a strapping machine, the method comprising:

clamping an end of a strap between first and second strap clamps;

moving the strap such that the strap extends around a strap engager of a leading-strap-end guide and extends across a third strap clamp;

after moving the strap such that the strap extends around the strap engager and extends across the third strap clamp, moving a counter-pressure plate from a retracted position in which the counter-pressure plate does not cover the strap engager, the first strap clamp, the second strap clamp, and the third strap clamp to a sealing position in which the counter-pressure plate covers the strap engager, the first strap clamp, the second strap clamp, and the third strap clamp;

moving the third strap clamp to clamp a first portion of the strap against the counter-pressure plate;

releasing the leading strap end from the first and second strap clamps; and moving the strap engager to clamp a second portion of the strap adjacent the leading strap end against the counter-pressure plate.

10. The method of claim 9, wherein moving the strap engager to clamp the second portion of the strap against the counter-pressure plate comprises rotating the strap engager.

11. The method of claim 9, further comprising moving the strap such that the strap extends around the strap engager and extends across the third strap clamp and a fourth strap clamp and moving the fourth strap clamp to clamp a third portion of the strap against the counter-pressure plate.

12. The method of claim 9, further comprising moving the strap such that the strap extends around the strap engager and extends across the third strap clamp after a strapped load has been removed from the counter-pressure plate.

* * * * *